US007094186B2

(12) United States Patent
Diakonov et al.

(10) Patent No.: US 7,094,186 B2
(45) Date of Patent: Aug. 22, 2006

(54) EXERCISE BAR

(75) Inventors: Yuri Diakonov, Clinton Township, MI (US); Rudolph R. Cugliari, Mt. Clemens, MI (US); Norbert T. Wierszewski, Dearborn, MI (US)

(73) Assignee: Burn Machine, LLC, Farmington Hills, MI (US)

( * ) Notice: Subject to any disclaimer, the term of this patent is extended or adjusted under 35 U.S.C. 154(b) by 0 days.

(21) Appl. No.: 10/870,607

(22) Filed: Jun. 17, 2004

(65) Prior Publication Data

US 2005/0187079 A1 Aug. 25, 2005

Related U.S. Application Data

(60) Provisional application No. 60/564,671, filed on Apr. 21, 2004, provisional application No. 60/547,590, filed on Feb. 25, 2004.

(51) Int. Cl.
*A63B 21/078* (2006.01)

(52) U.S. Cl. ..... 482/104; 482/106; D21/679

(58) Field of Classification Search ..... 482/104–106, 482/38, 41, 907, 91, 44–46, 50; D21/679–682, D21/14, 23
See application file for complete search history.

(56) References Cited

U.S. PATENT DOCUMENTS 4,461,473 A * 7/1984 Cole ..... 482/106
4,487,413 A * 12/1984 Fall ..... 482/91
4,618,143 A * 10/1986 Twardosz ..... 482/106
4,629,184 A 12/1986 Selkee ..... 272/123
4,674,987 A * 6/1987 Sober ..... 446/170
4,690,400 A * 9/1987 Metz ..... 482/106
4,743,018 A 5/1988 Eckler ..... 272/123
4,822,035 A * 4/1989 Jennings et al. ..... 482/106
RE33,218 E 5/1990 Twardosz ..... 272/123
5,024,434 A * 6/1991 Smith ..... 482/107
5,334,113 A * 8/1994 Roepke ..... 482/106
5,407,405 A * 4/1995 Oren ..... 482/50
5,725,461 A * 3/1998 Bogard, II ..... 482/106
5,735,779 A * 4/1998 Lay ..... 482/93
6,022,300 A * 2/2000 Hightower ..... 482/106
6,450,928 B1 * 9/2002 Larkins, Jr. ..... 482/110
6,461,282 B1 * 10/2002 Fenelon ..... 482/106
6,971,974 B1 * 12/2005 Bowman et al. ..... 482/107

* cited by examiner

*Primary Examiner*—Lori Amerson
(74) *Attorney, Agent, or Firm*—Gifford, Krass, Groh, Sprinkle, Anderson & Citkowski, P.C.

(57) ABSTRACT

An exercise barbell comprises a pair of rings connected by a pair of curved bars. The rings rotatably support handle members. Extensions of the bar on the exterior of the two rings support crescent-shaped weights which conform to the outer diameter of the ring and to one another. The weights are relatively flat so the entire apparatus lies in a single plane. A straight bar connecting the opposed sides of the two rings supports a sliding weight which may be moved to one side of the bar or the other to allow asymmetrical exercises.

17 Claims, 4 Drawing Sheets

EXERCISE BAR

RELATED APPLICATION

This application claims priority of U.S. Provisional Patent Application Ser. No. 60/547,590 filed Feb. 25, 2004, and U.S. Provisional Patent Application Ser. No. 60/564,671, filed Apr. 21, 2004 which are incorporated herein by reference.

FIELD OF THE INVENTION

This invention relates to a barbell for exercise purposes such as weightlifting and more particularly to such exercise apparatus which includes means for supporting a number of weights on both ends of the apparatus and includes rotatable handgrips, a sliding counterweight supported on a central bar, and rectangular curved weights which may be supported on the ends of the apparatus.

BACKGROUND OF THE INVENTION

Barbells are commonly used to perform a variety of exercises including curling and weightlifting, and it has been proposed to provide rotating handgrips for use in such apparatus so that the user's grip may be accommodated in any position and is not restricted to an angle parallel to the axis of the device. In particular, U.S. Pat. Nos. 3,384,370; 4,618,183; 4,629,184; 5,334,113; 6,022,300 and Re. 33,218 all disclose barbell arrangements having handgrips which are rotatably supported so that their angle relative to the bar may be adjusted.

One problem associated with prior art barbells resides in the fact that if the bar is to resist the bending forces imposed when the bar is lifted with weights on the end, it must be formed of a strong and relatively heavy material. The weight of this bar imposes a minimum weight on the exercise apparatus even without any end weights. Another problem is that the use of disk-like end weights creates problems in storage and transportation of a barbell with the associated weights.

Another problem associated with conventional barbells, with or without rotatable handgrips, is that it is inconvenient and awkward to provide a greater weight on one end than the other in order to impose asymmetrical stresses on the user's muscles during exercise.

SUMMARY OF THE INVENTION

These problems are addressed by our invention, which is disclosed in detail subsequently, and which provides a weightlifting apparatus including a pair of spaced outer rings which support rotatable handgrips and, in a preferred embodiment of the invention, are connected to one another by a supporting structure constituting a pair of intermediate bars each connected at its opposite ends to the opposed edges of the two rings which support the rotatable handles. The connecting bars are preferably curved and joined to the rings so as to present their curved surfaces externally of the barbell and their opposed concave surfaces facing one another. These connecting bars do not extend beyond lines tangent to the two handle supporting rings so that the bars will not hit the user's body during exercise. The connecting bars are preferably formed of tubular steel so that they may have a lower weight collectively than the single conventional longitudinal bar of a barbell. While the connecting bars of the present invention are preferably curved, in other embodiments of the invention they could be formed of straight sections, sections with an intermediate bend projecting outwardly or elliptical sections.

Each of the outer rings rotatably supports an inner ring having an outer diameter complementary to the inner diameter of the outer ring. The bearing surface between the inner diameter of the outer ring and the outer diameter of the inner ring may either be frictional or may be equipped with anti-friction bearings such as ball bearings, roller bearings, or the like. Alternatively, low friction materials such as nylon may be coated on the contacting surfaces. Each inner ring is bisected with a grip handle so that the inner ring may be rotated to any convenient position within the outer ring by forces exerted on the handles.

This construction provides a very strong, lightweight, rigid exercise apparatus.

In embodiments of the invention which will be subsequently disclosed in detail, the supporting structure for the rings includes a central straight bar, preferably formed of tubing, connecting the two rings at their points of closest separation, midway between the two outer connecting bars. A relatively small weight is slidingly supported on this central bar so that when the bar is tipped in one vertical direction or the other, the weight will slide toward the downward end. Thus the bar may be weighted in an asymmetrical manner so that the work exerted by the exerciser is greater on the side with the weight than the opposite side. This allows the exerciser to provide higher forces to one muscle group than another and allows shifting of the weights between exercises. Thus, asymmetrical stresses may be imposed to exercise the oblique muscles and related groups.

Prior art barbells typically employ disk-shaped weights. In one embodiment of the present invention the weights to be secured on supporting extensions on the outer sides of the two outer rings are elongated rectangles, preferably crescent-shaped and curved to a radius similar to the rings so that the innermost weight can rest against the ring and the outermost weights curve around the inner weights. The rectangles extend parallel to the rings to give the entire bar, with the associated weights, a narrow profile for storage or transportation.

The exercise device of the present invention is useful for a wide variety of exercises. In particular:

1. The biceps may be exercised by lifting and rotating with the handle parallel to the central axis;
2. The triceps may be exercised by lifting and rotating with the handles perpendicular to the central axis;
3. The trapezius muscles may be exercised with grips on the end of either curved connecting bar;
4. Pushups may be performed with hands on the handle perpendicular to the central axis; and
5. A normal bench press may be performed with the correct support angles safely because the double connecting bar lies on the chest rather than creating the danger of a single conventional bar hitting the thorax.

It is contemplated that a version of the present invention may be produced without extending weight supporting sections on the outer sides of the two rings. This version would provide a single weight for exercise and would be useful for lower strength individuals, and some females, as well as being more compact for storage and transportation than the version with the extending weight supporting sections.

BRIEF DESCRIPTION OF THE DRAWINGS

Other objects, advantages and applications of the present invention will be made apparent by the following detailed description of preferred embodiments of the invention. The description makes reference to the accompany drawings in which.

DETAILED DESCRIPTION OF THE INVENTION

Figure 1:
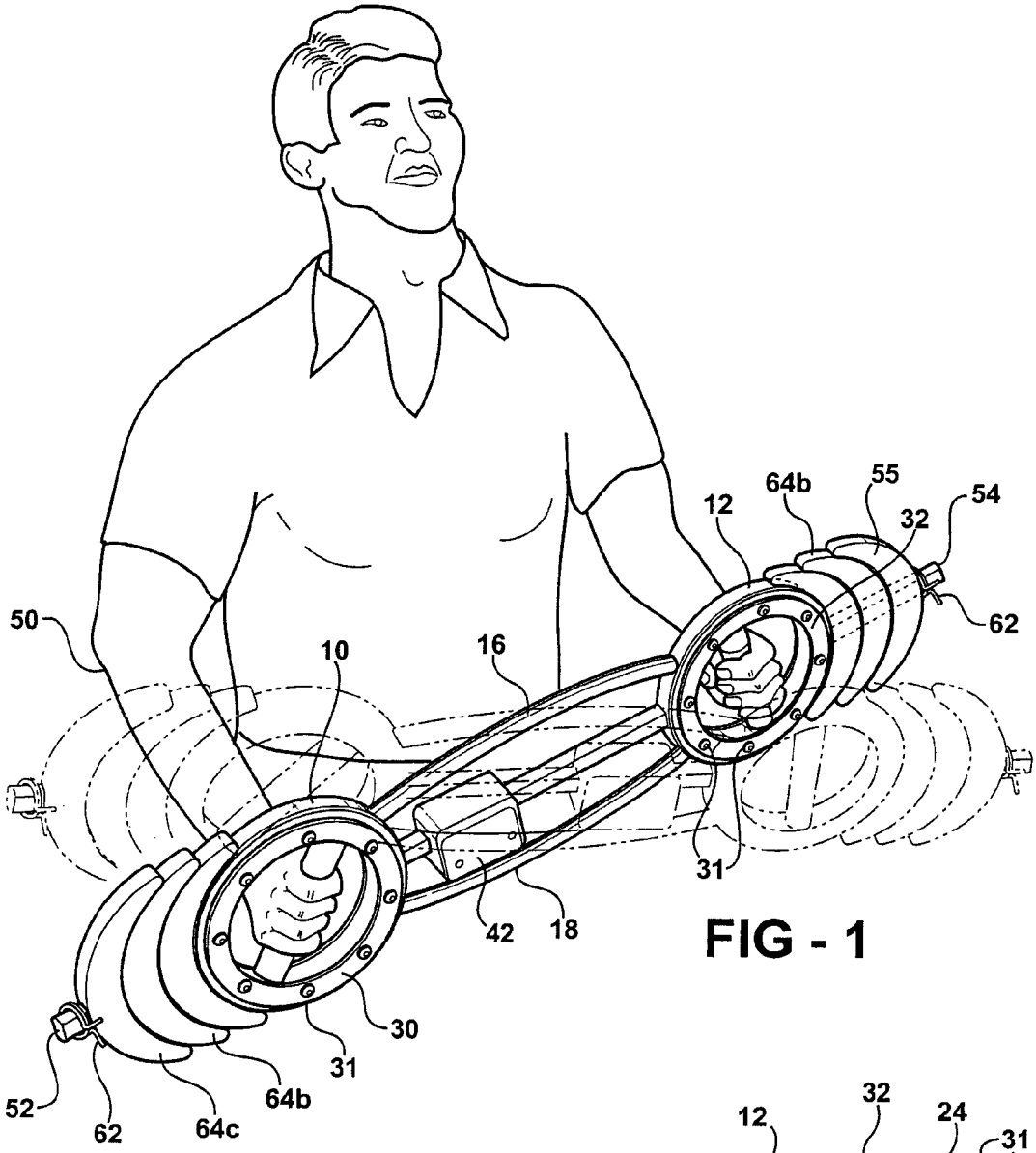
FIG. 1 is a perspective view of a person using a first embodiment of the barbell for exercising, illustrating, in phantom lines, the alternative positions for imposing asymmetrical forces on the muscles.

Referring to FIGS. 1–4, a preferred embodiment of our exercise apparatus comprises a pair of outer rings 10 and 12, preferably formed of tubular steel, aluminum or another rigid material. The rings 10 each have a number of tapped holes 14, formed in regular intervals about their perimeter for securing inner rotatable rings in a manner which will be subsequently described.

The two outer rings 10 and 12 are joined to one another by a pair of curved, tubular, connecting bars 16 and 18. The ends of the bars are welded, or otherwise secured to spaced points on the perimeter of the outer rings 10 and 12. A straight center bar 20, which is preferably rectangular in cross-section, extends intermediate the two curved connecting bars 16 and 18 and also has its ends secured to the outer perimeter of the two rings 10 and 12 midway between the points of connection of the bars 16 and 18. The connecting bar 20 may be solid or tubular. The bars 16, 18 and 20 are connected to the rings 10 and 12 so that the rings, as well as their connecting bars, all lie in a common plane. The lengths of the bars 16, 18 and 20 are preferably such that the centers of the two rings 10 and 12 are separated by approximately 10–15 inches, which represents a comfortable distance for gripping the exercise apparatus.

A pair of inner rings 22 and 24 which have outer diameters slightly smaller than the inner diameters of the rings 10 and 12, are secured within the outer rings by opposed pairs of retaining plates 28, 30, 32 and 34. The retaining plates 28, 30, 32 and 34 have a number of screw holes 36 formed through their thickness. The retaining rings may be secured to the opposed faces of the outer rings 10 and 12 with screws 31, to capture the inner rings 22 and 24 between them. Inner rings 22 and 24 make a loose fit within the inner diameters of the outer rings 10 and 12. Each of the inner rings 22 and 24 has a cylindrical grip member 38 and 40, preferably with a serrated surface, extending diametrically across the respective ring.

A metal weight 42 is slidably supported on the straight connecting bar 20. The fit is such that it may easily slide from one side to the other, as the bar is appropriately inclined. In FIG. 1, the weight 42 is shown at the end toward the right arm of the exerciser 50 and shown in phantom at a position adjacent to his left arm. In the embodiment of FIGS. 1 through 4, weight supporting, rectangular cross-section extensions 52 and 54, are fixed to the outer rings 10 and 12 respectively, at points diametrically opposed to the points where the center connecting bar 20 joins those rings.

Figure 3:
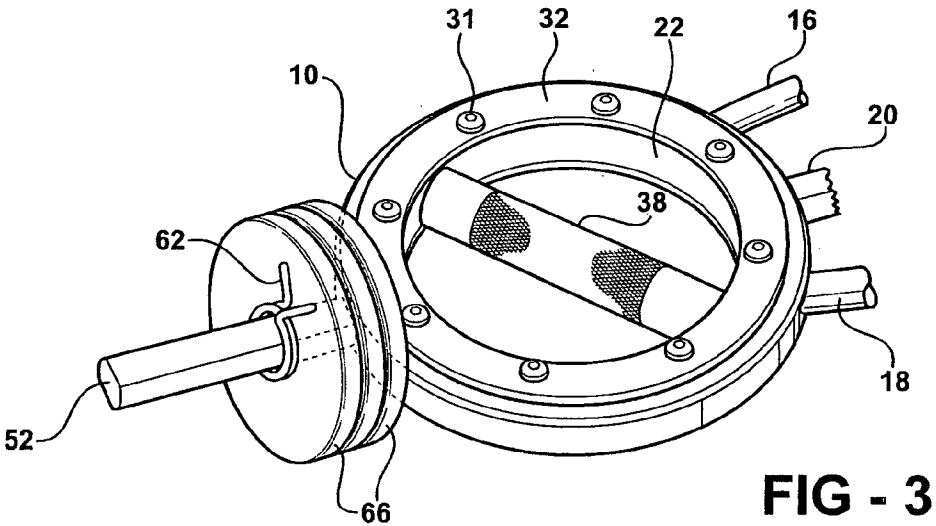
FIG. 3 is a fragmentary perspective view of the embodiment of FIG. 2 supporting conventional disc-shaped weights.
Figure 4:
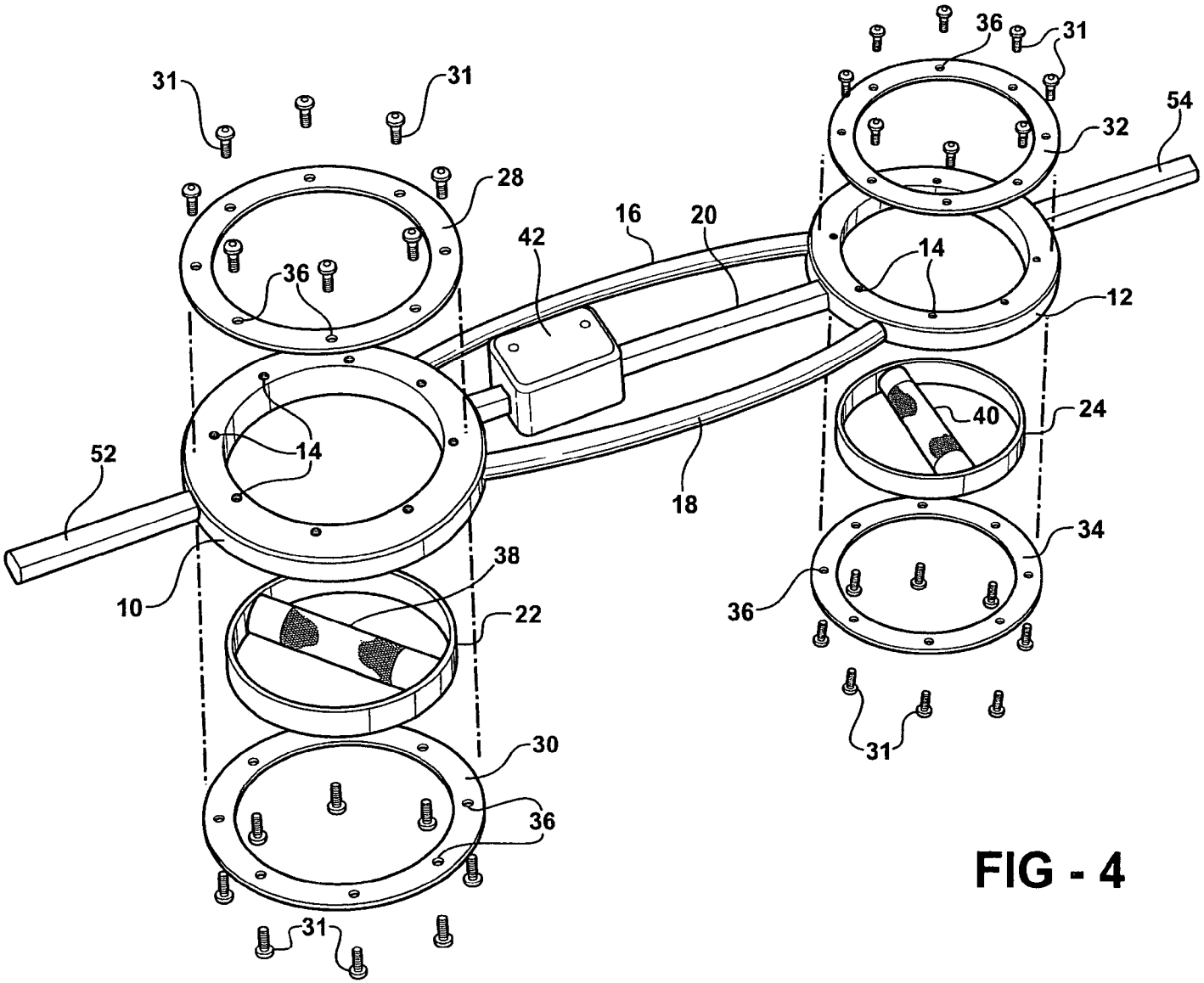
FIG. 4 is an exploded view of a preferred embodiment of our invention.
Figure 6:
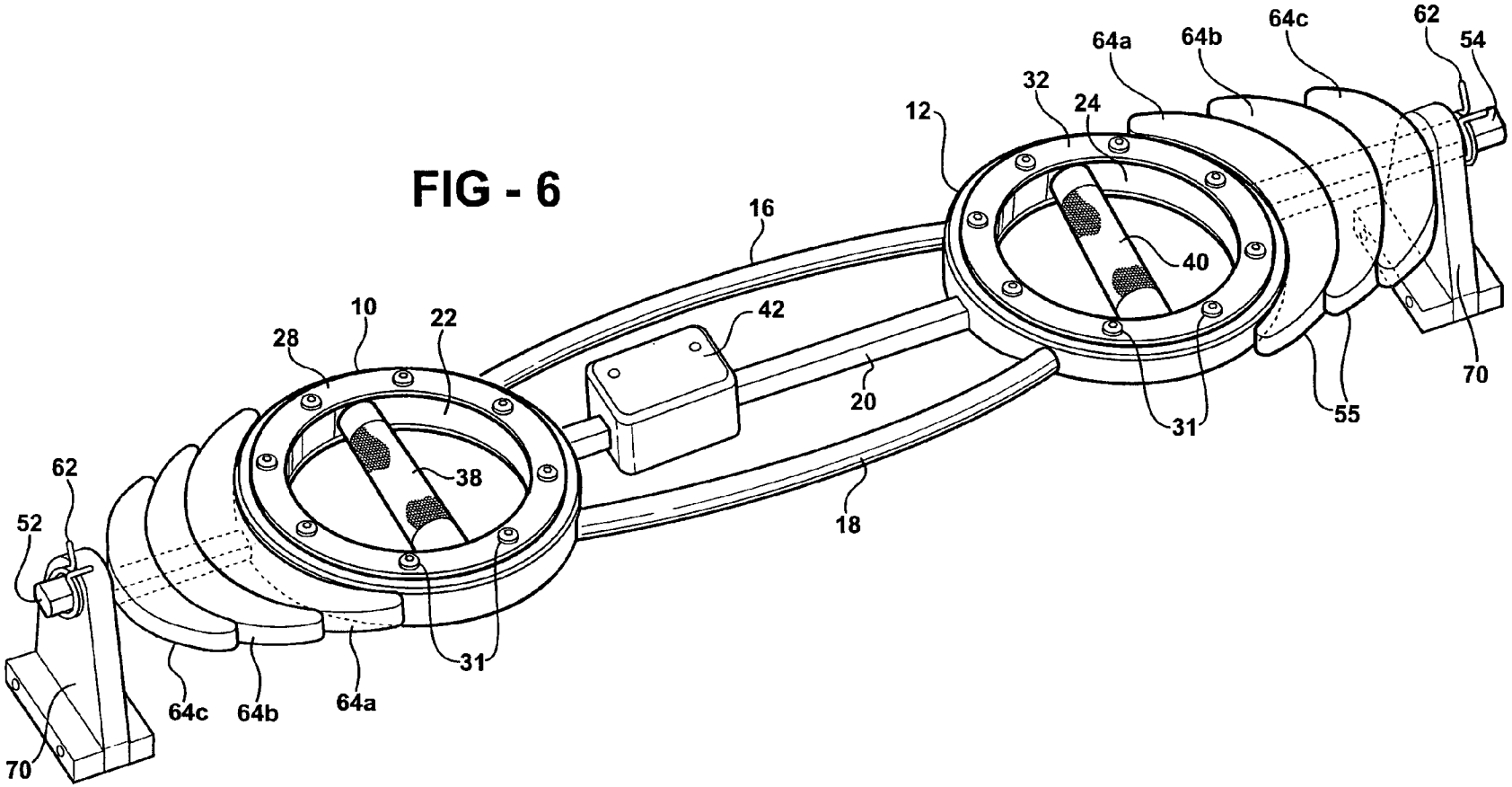
FIG. 6 is a perspective view of an alternative embodiment of the invention.

A plurality of weights may be supported on each extension 52 and 54 in the manner of a conventional barbell. FIGS. 1 and 3 illustrate crescent-shaped weights formed in accordance with the present invention. FIG. 3 illustrates several conventional disc-shaped weights 60 secured on a bar end 52 and retained by a conventional spring clip 62.

Another novel aspect of the present invention resides in the use of crescent-shaped weights 64A, 64B, and 64C, rather than the conventional disc-shaped weights 60. These crescent-shaped weights preferably have a thickness similar to the thickness of outer rings 10 and 12 and have central holes which allow them to be supported on the extensions 52 and 54. They may be retained with conventional spring slips 62. When equipped with the crescent-shaped weights, the exercise apparatus has a relatively flat profile and my be conveniently stored or packaged. The crescent-shaped weight 64A has a concave surface with a diameter that approximates that of the outer ring so it slightly extends around the outer ring. The weights 64B and 64C have concave surfaces which allow them to closely nestle the convex surfaces of the larger weights.

The crescent-shaped weights provide a number of advantages over conventional weightlifting bars which may be equipped with disc-shaped weights with central holes that fit over an extending bar such as the bar 52 in addition to the resulting compact configuration and ease of storage. Disc-shaped weights tend to rotate during exercise resulting in forces that destabilize the conventional exercises that may be performed by the bar. The crescent-shaped weights lock into one another to prevent rotation. Additionally, the crescent-shaped weights minimize the length of the exercise bar and thus lower force moments which tend to cause the bar to twist during use. Finally, disc-shaped weights tend to make contact with the user's elbows during many exercises, particularly trapezius pulls involving grabbing the center of the bar with both hands and lifting towards the chin. Since the crescent-shaped bars do not extend out of the plane of the weightlifting apparatus, they do not create such interference.

Figure 5:
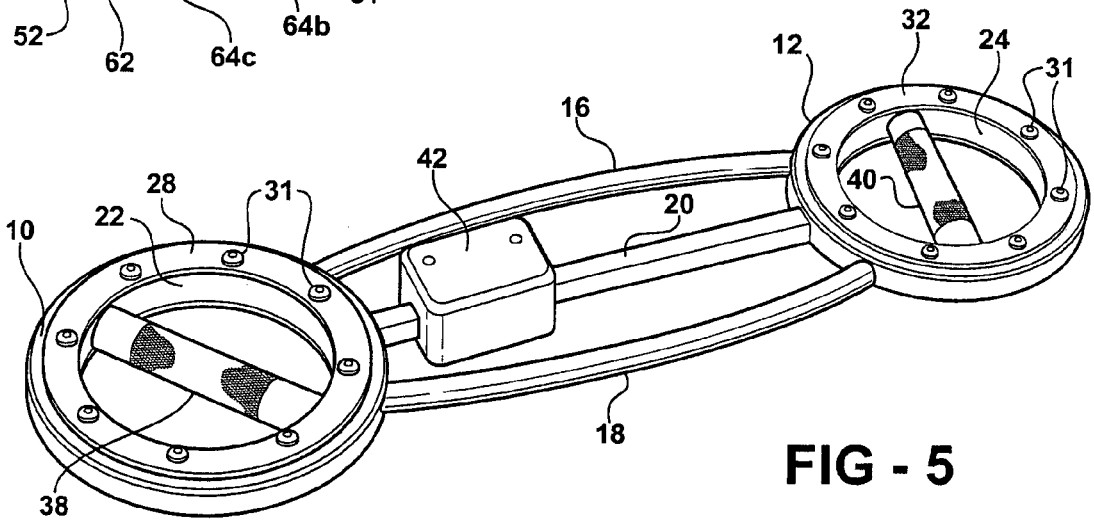
FIG. 5 is a perspective view of an alternative embodiment of the invention without end bars for supporting additional weights.
Figure 2:
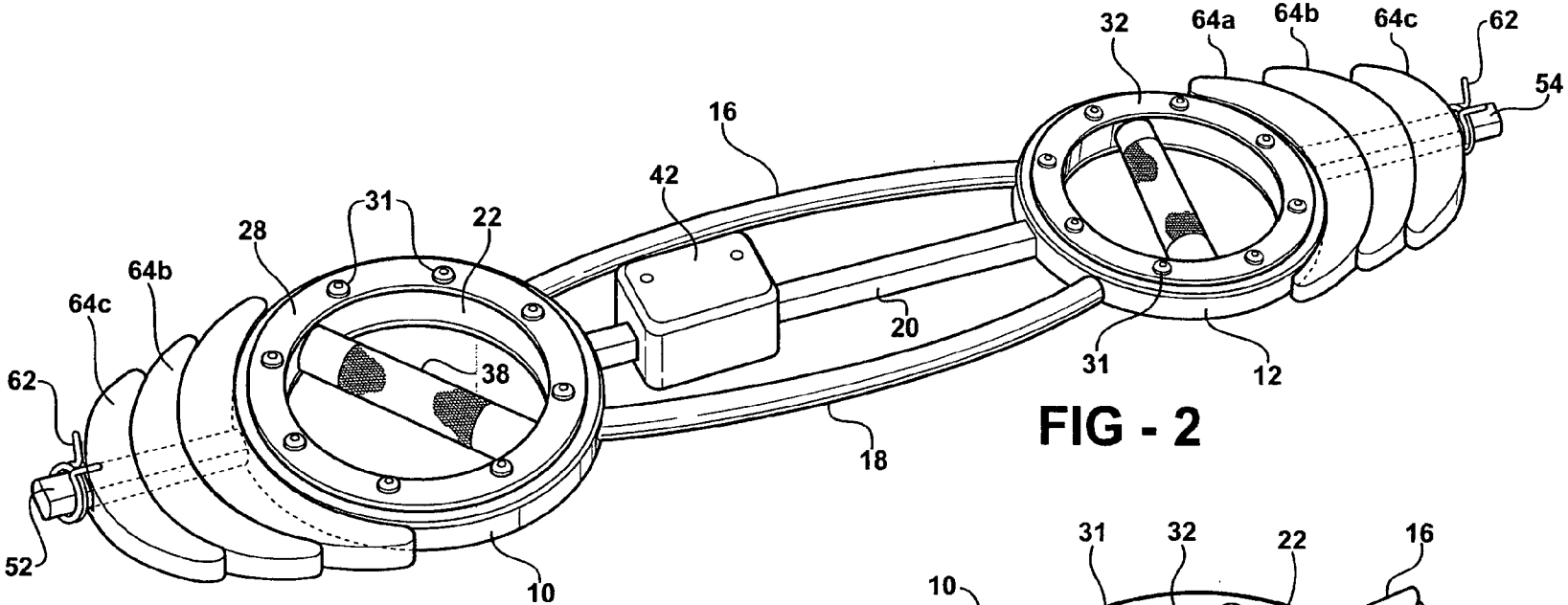
FIG. 2 is a top perspective view of the preferred embodiment of our invention carrying several crescent-shaped weights.

The embodiment of the invention illustrated in FIG. 5 does not have the weight supporting extensions 52 and 54 which form part of the first embodiment of the invention. Rather, the exercise apparatus simply consists of the rings and their rotatable handles and the associated connecting bars and the sliding weight.

In alternative embodiments of the invention, an anti-friction bearing could be used to support the inner rings 22 and 24 within the outer rings 10 and 12. This might be a ball bearing or a roller bearing. Alternatively, the engaging surfaces of one of the elements could be coated with an anti-friction material.

Alternate physical arrangements also might be employed for securing the inner rings 22 and 24 within the outer rings 10 and 12, as opposed to the retaining plates illustrated in the drawings.

The use of connecting bars 16, 18 and 20 which are preferably tubular, gives the weightlifting apparatus a rigidity without the weight of conventional barbells.

In an alternative embodiment to the invention, the center bar 20 and its supporting sliding weight 42 could be omitted so as to only allow for symmetrical exercises.

As illustrated in FIG. 1, by inclining the bar in one direction or another, asymmetrical forces would be imposed on the exerciser's muscles while using the bar for otherwise conventional exercises.

We claim:

1. A weightlifting device comprising:

a plurality of continuous outer rings lying in a common plane, joined in spaced relationship to one another by a pair of connecting bars lying in said plane, each bar having one end connected to a point on one of the rings and its other end connected to a point on the opposite ring, the points on the rings to which each of the pair of bars are attached being spaced from one another and being on the side of each ring closest to the other ring; and fixed length handle members freely rotatably supported within each of the outer rings, so that when grasped by a user's hands they may be moved to any orientation within the supporting outer ring.

2. The weightlifting device of claim 1 in which the bars are curved so as to have concave surfaces facing one another.

3. The exercise device of claim 1, further including elongated end extensions joined to the outer sides of the two outer rings for supporting weights.

4. The exercise device of claim 1, further including a straight center bar extending between opposed sides of the two outer rings between the connecting bars and supporting a sliding weight which can be moved to either side of the exercise device by tilting that side of the device downwardly with respect to the other side.

5. The exercise device of claim 3, further including crescent- shaped rectangular weights, curved to the same radius as the rings, adapted to be supported on the end extensions.

6. The exercise device of claim 5, wherein the weights have a thickness similar to the rings.

7. The weightlifting device of claim 1, wherein the handle members rotatably supported within the outer rings constitute bisectors of a pair of inner rings which are journalled within the outer rings so as to be rotatably supported therein.

8. An exercise barbell comprising:

a pair of continuous, metal, outer rings;

a pair of connecting bars each joining the two outer rings, each bar having one end fixed to the periphery of one of the outer rings and its other end fixed to the periphery of the other outer ring, the points of connection of the two bars to a ring being spaced from one another on the side of a ring closest to the other ring, the outer rings and the two connecting bars all lying in a common plane;

continuous inner rings rotatably supported within each of the outer rings; and elongated handle members having their ends fixed to diametrically opposed points on each of the inner rings, so the inner rings, and the handles, may be rotated to any orientation with respect to the outer rings.

9. The exercise barbell of claim 8, wherein the connecting bars are each curved and are connected to the outer rings so that the bars lie with their concave faces opposing one another.

10. The exercise barbell of claim 8, further including a central, straight connecting bar joined to peripheries of the two outer rings at points spaced between the points of connection of the two connecting rods.

11. An exercise barbell comprising:

a pair of tubular, continuous, metal outer rings;

a pair of tubular connecting bars joining the two rings, each bar having one end fixed to the periphery of one of the outer rings and its other end fixed to the periphery of the other ring, the points of connection of each of the two bars to the two rings being spaced from one another and being on the sides of the rings which are closest to each other, the outer rings and the two connecting bars all lying in a common plane;

continuous inner rings freely rotatably supported within each of the outer rings by retainer plates which are secured to the opposed faces of the outer rings and overlap the peripheral faces of the inner rings;

elongated handle members having their ends fixed to diametrically opposed points over each of the inner rings;

extension bars secured to each of the outer rings at points lying on an axis extending through the centers of the two outer rings; and a plurality of crescent-shaped weights having central holes adapted to be arrayed over the extension bars.

12. The barbell of claim 11, wherein the first crescent-shaped weight arrayed on an extension bar nestles against the outer diameter of one of the rings and the concave surfaces of the other weights arrayed on that extension bar nestle against the convex surfaces of previously loaded weights.

13. The barbell of claim 12 further including a weight slidably supported on a connecting bar between the end rings so it may be moved toward one end ring or the other to produce asymmetrical loading during exercise.

14. An exercise device, comprising:

a pair of continuous rings;

elongated handle members having their opposed ends connected to diametrically opposed points on the interior of each ring, each handle member being freely rotatably supported with respect to its associated ring so that it may be rotated to any orientation with respect to its ring, in the plane of the ring; and a supporting structure extending between the rings and rigidly connected to each of the rings so as to retain them in spaced relation in a common plane, the supporting structure lying in that plane, and comprising a pair of opposed edges extending between the rings, and having a greater width, measured normally to a line in the common plane extending between the centers of the rings, than thickness measured along a line normal to the common plane.

15. The exercise device of claim 14 wherein the opposed edges of the supporting structure are curved.

16. The exercise device of claim 14, further comprising adjustable weight means supported by the supporting structure.

17. An exercise device, comprising:

a pair of continuous rings;

elongated handle members having their opposed ends connected to diametrically opposed points on the interior of each ring, each handle member being freely rotatably supported with respect to its associated ring so that it may be rotated to any orientation with respect to its ring, in the plane of the ring; and a supporting structure extending between the rings and rigidly connected to each of the rings so as to retain them in spaced relation in a common plane, the supporting structure lying in that plane, being contained within an area bounded by a pair of parallel lines in the plane extending tangential to the rings on opposite sides of the rings, and comprising a pair of opposed edges extending between the rings, and having a greater width, measured normally to a line in the common plane extending between the centers of the rings, than thickness measured along a line normal to the common plane.

* * * * *